United States Patent [19]

Blattner

[11] Patent Number: 5,031,865

[45] Date of Patent: Jul. 16, 1991

[54] MOBILE CARD FILE

[76] Inventor: Patrick D. Blattner, 1205 Princeton Pl., Cleburne, Tex. 76031

[21] Appl. No.: 523,729

[22] Filed: May 15, 1990

[51] Int. Cl.[5] ..... A47G 29/00

[52] U.S. Cl. ..... 248/122; 40/372; 224/42.45 R; 248/126; 248/177; 248/205.8; 248/215; 248/231.7

[58] Field of Search ..... 248/122, 126, 187, 177, 248/205.8, 205.2, 205.3, 181, 215, 231.7, 224.4, 224.3; 40/378, 379, 372, 391, 377; 224/42, 45, 227

[56] References Cited

U.S. PATENT DOCUMENTS

| | | | |
|---|---|---|---|
| 1,751,895 | 3/1930 | Stewart | 248/181 X |
| 3,106,920 | 10/1963 | Scholfield et al. | 40/379 X |
| 3,146,868 | 9/1964 | Lang | 192/8 |
| 3,307,740 | 3/1967 | Fant | 248/205.2 X |
| 3,321,068 | 5/1967 | Beach | 248/205.2 X |
| 3,721,485 | 3/1973 | Beger | 312/330 |
| 4,012,007 | 3/1977 | Cunningham | 248/205.8 X |
| 4,035,938 | 7/1977 | Neilsen | 40/379 |
| 4,159,773 | 7/1979 | Losenno | 248/224.3 X |
| 4,231,625 | 11/1980 | Perez et al. | 224/42.45 R |
| 4,418,496 | 12/1983 | Koistinen | 248/215 X |
| 4,623,112 | 11/1986 | Olson | 248/205.3 X |
| 4,733,836 | 3/1988 | Barnes | 248/122 |
| 4,790,440 | 12/1988 | Leszczak | 211/11 |
| 4,846,803 | 7/1989 | Emerson | 248/231.7 X |
| 4,942,990 | 7/1990 | White | 224/42.42 |

OTHER PUBLICATIONS

Brookstone Corporation's Feb. 1990 mail order catalog, p. 8.

*Primary Examiner*—David L. Talbott
*Attorney, Agent, or Firm*—Vidas & Arrett

[57] ABSTRACT

A portable card file capable of being removed from its base such that it may be inserted into another base at a different location. The base is mountable in a vehicle.

32 Claims, 3 Drawing Sheets

10
20
90
94
91

138
134
132
135
139
137
136

10
130
16
92

30
80
82

70
71

MOBILE CARD FILE

BACKGROUND OF THE INVENTION

1. Field or the Invention

This invention relates to a mobile card file which contains a head for holding index cards and a base or fastening means constructed and arranged so that the head is removably attached to the base or fastening means and may be inserted into another base or fastening means at a different location.

2. Description of the related art

Rotary card files are known in the art, such as Rolodex® brand rotary card files. However, these rotary card files in existence are not easily transferable from an office or stationary setting to a non-stationary setting such as a vehicle.

With the advent of the mobile car telephone, many people now work out of their automobiles. This necessitates carrying file books, address and telephone numbers and the like in order to more easily communicate with the public. A problem with current office information systems is that they are not easily mobile.

SUMMARY OF THE INVENTION

The invention consists of a head for holding a plurality of index cards and a base or fastening means which supports the head. The base or fastening means can be attached permanently or temporarily to a variety of surfaces. The head is removably attached to the base or fastening means. This removability allows for the head to be transferred from one base to another at a different location. The head or card file thus becomes "mobile" or "portable".

The head is constructed such that it has full range of rotation and tilt relative to the base and may be placed in any position desired by the user. A locking mechanism built into the device will allow the user to lock the head in the desired position.

DESCRIPTION OF THE PREFERRED EMBODIMENTS

Figure 1:
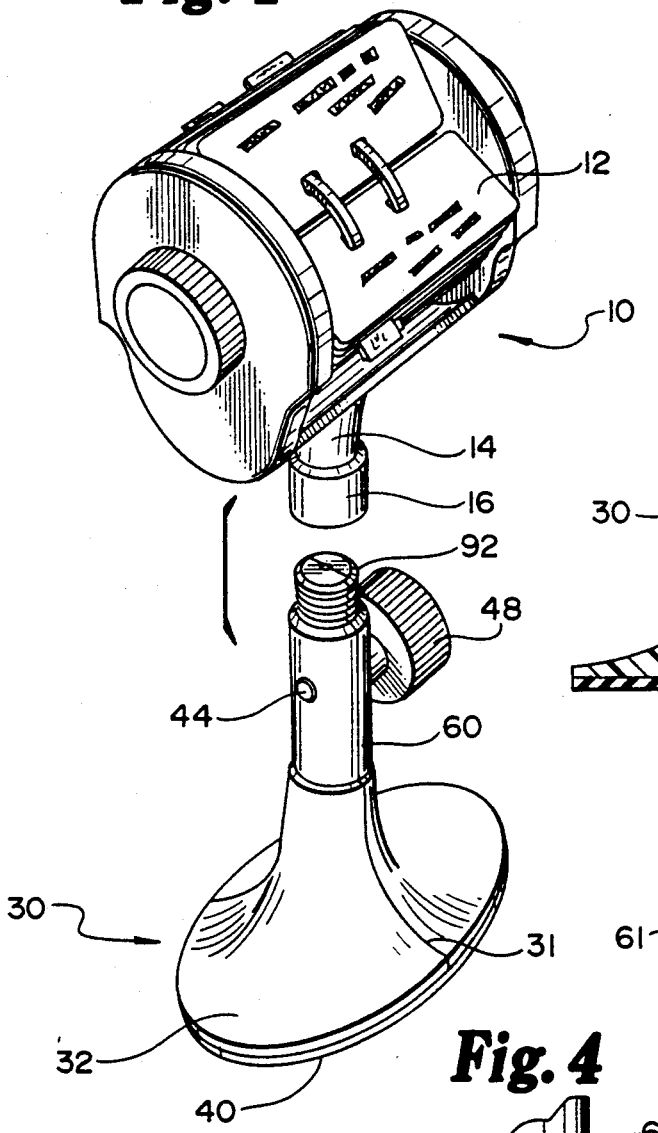
FIG. 1 is an exploded perspective view of the preferred form of the present invention.

FIG. 1 illustrates a rotary card file containing a head member 10 removably attached to a base "means" 30 and which further contains a stem member 60. The head member 10 is constructed and arranged for holding a plurality of index cards 12 carrying information and includes means for selectively viewing one card at a time. Although a rotary head is shown, head member 10 may be a non-rotary index card head. Attached to the head is a neck member 14 with a terminal ferrule 16, said ferrule containing an internal thread (not shown). The base means 30 includes a support base structure 32 and a stem member 60 extending outwardly from the base means, said stem member having a terminally threaded nipple 92 for receiving the head member 10. The head is received onto the base means by threading the ferrule 16 with the nipple 92. A coupling cap may be used to achieve the same purpose as the ferrule without the necessity to turn the entire head when attaching the same onto the base means. Beneath the support base is located a suction cup 40 constructed and arranged for securing the base means to a surface. A surface such as a dash board of an automobile is envisioned. A parting line 31 is present in the base means where the base means is attached during assembly.

FIGS. 2–6 illustrate a standard suction mechanism.

An internal opening 52 is present within the stem of the base means to allow for placing of rod groove 56 and connecting rod 54.

Figure 2:
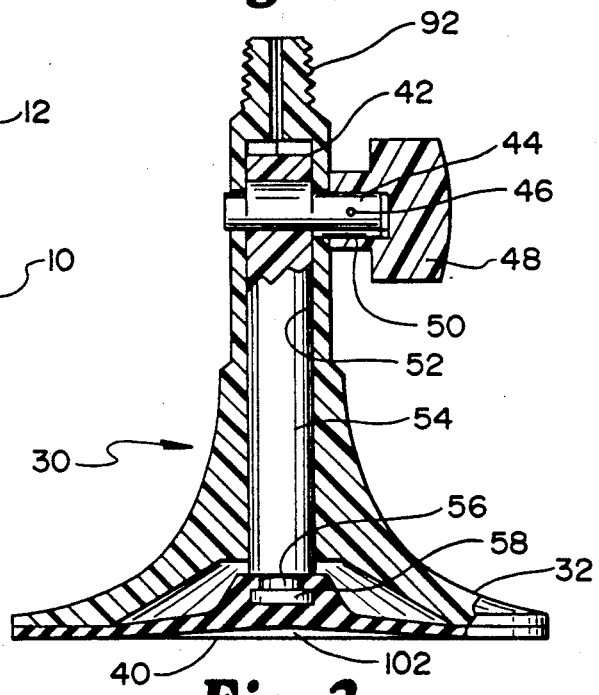
FIG. 2 is a front elevational view thereof showing base with parts cut away.
Figure 6:
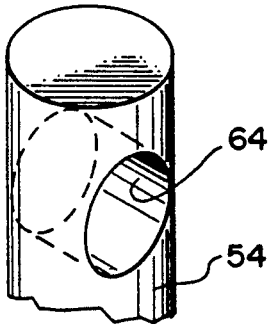
FIG. 6 is a fragmentary perspective detail thereof showing connecting rod end.

The connecting rod 54 shown in FIGS. 2 and 6 contains a cam hole 64 to which the eccentric cam 42 of the actuator axle 44 abuts.

The suction is created by a user turning the actuator knob 48 relative to the base means, which surrounds the actuator axle 44. A knob retainer pin 46 threads into pin hole 62 within the actuator axle 44 and holds the knob 48 in place to allow for usage. A registration rib 50 slides into registration notch 51 upon turning of the knob 48. A clearance hole 61 which is formed in the stem 60 is large enough to permit the axle 44 with the registration rib 50 to turn and allow the notch and rib to meet. Upon engagement of axle 44 and the registration rib 50 into the notch 51, which fit into the registration hole 53, the rod groove 56 and lip 58 are lowered into the void space 102 and create the suction causing the base means to adhere to a given surface. Simultaneously upon engagement of rib 50 and notch 51, the eccentric cam 42 engages into a cam hole 64, shown in FIG. 6, which is formed in the connecting rod 54.

Figure 7:
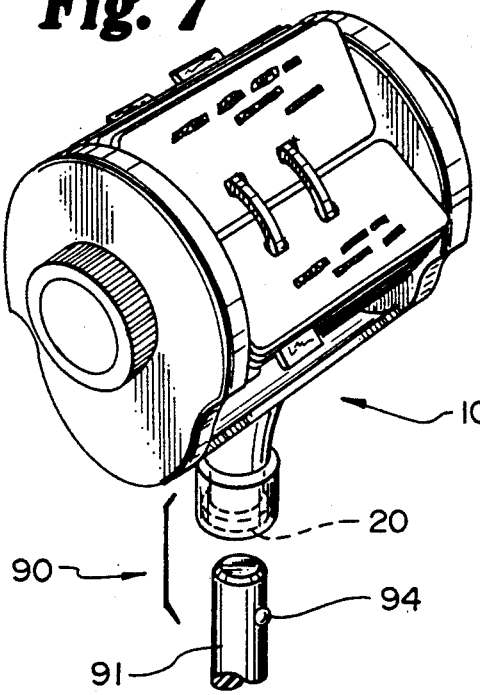
FIG. 7 is a fragmentary perspective thereof showing an alternate form of ferrule connection.
Figure 11:
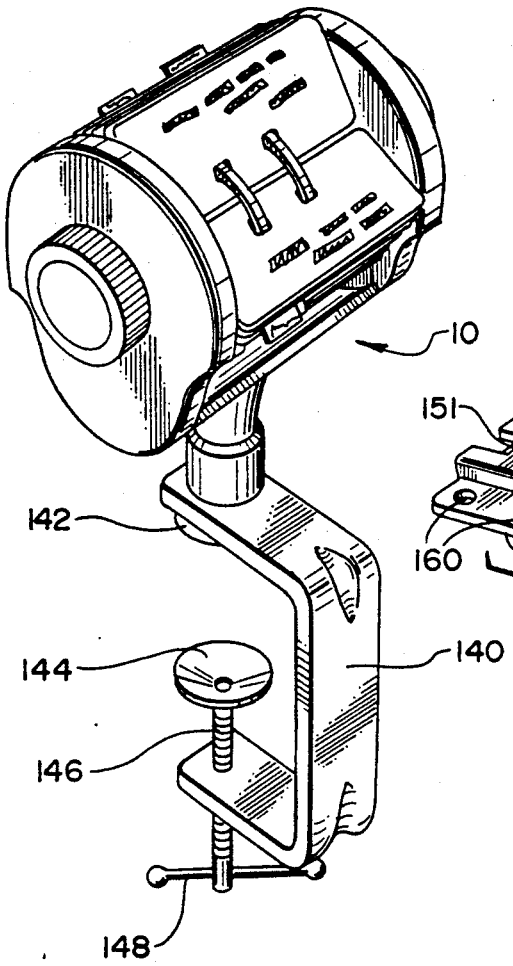
FIG. 11 is a perspective detail thereof showing a C-clamp base mount.

FIG. 7 illustrates an alternate embodiment to the threaded nipple mechanism shown in FIGS. 1 and 2 for the removal of the head from the base or fastening FIG. 11 illustrates a standard C-clamp 140 containing a clamp screw 146 which is turned via a "T"-bar 148. A puck 144 at the end of the clamp screw 146 secures the head 10 to the desired surface by butting up against the surface.

The head 10 may be fixedly attached to the clamp as shown in FIG. 11 via a common fastener 142.

Figure 12:
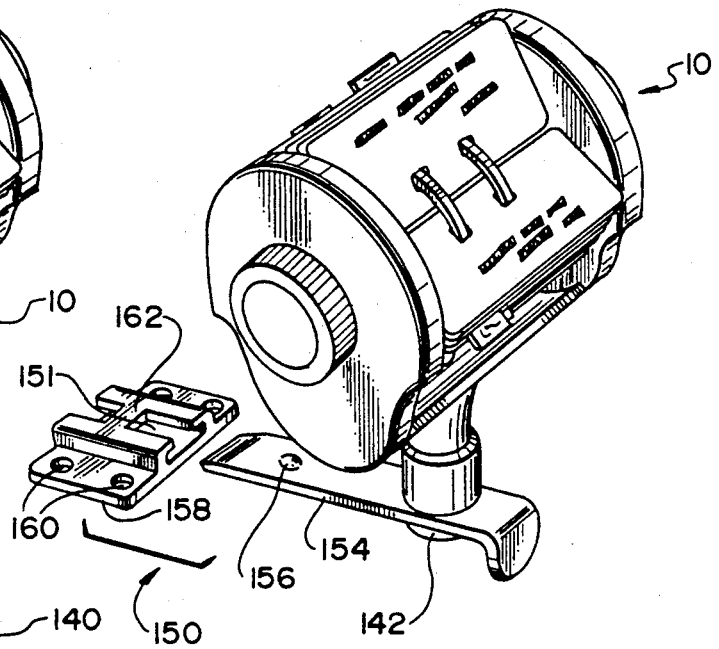
FIG. 12 is a perspective detail thereof showing a spade base mount.

FIG. 12 illustrates a standard spade socket mount 150. A bracket 158 is fixedly attached to a surface via the mounting holes 160 or adhesion or the like. A bridge detent 162 which contains spade socket 151 accepts a spade 154 to which is attached a head 10. A nerd detent 156 allows secure engagement of the spade onto the bracket.

Figure 13:
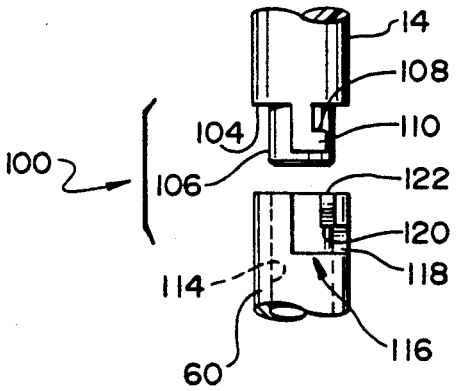
FIG. 13 is a fragmentary side elevational exploded detail thereof showing a bayonet connection on mount.

FIG. 13 illustrates a standard bayonet mount 100 to allow for push button releasability of the head from the base or fastening means. This bayonet mount may be placed either on the base means, fastening means or the stem holding the head. A bayonet post 106 is attached to the neck member 14 of the head 10. A step 104 ends with a land 108 and a male lug 110. A bayonet socket 114 is adapted to receive the bayonet post 106. The socket 114 consists of an end 122 to which is attached an abutment lug 120 and a lug bay 118. At the base of the lug bay is located a female lug 116. The male lug 110 of the bayonet post is locked into the bayonet socket by a turning action in which the female and male lug meet.

Figure 14:
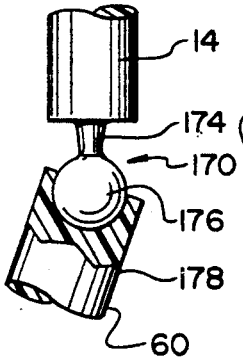
FIG. 14 is a fragmentary detail with parts cut away thereof showing a detachable ball and socket connection on mount.

FIG. 14 illustrates a standard ball and socket mount which allows for rotation and tilting of the head 10. This mount 170 consists of a spherical ball 176 attached to a stand off 174 which in turn is a attached to the neck member 14 of the head 10. means. A ball detent socket mount 90 allows for vertical removal of the head 10 from a post 91. A ferrule 20 with internal grooves snaps over a ball detent 94.

Figure 8:
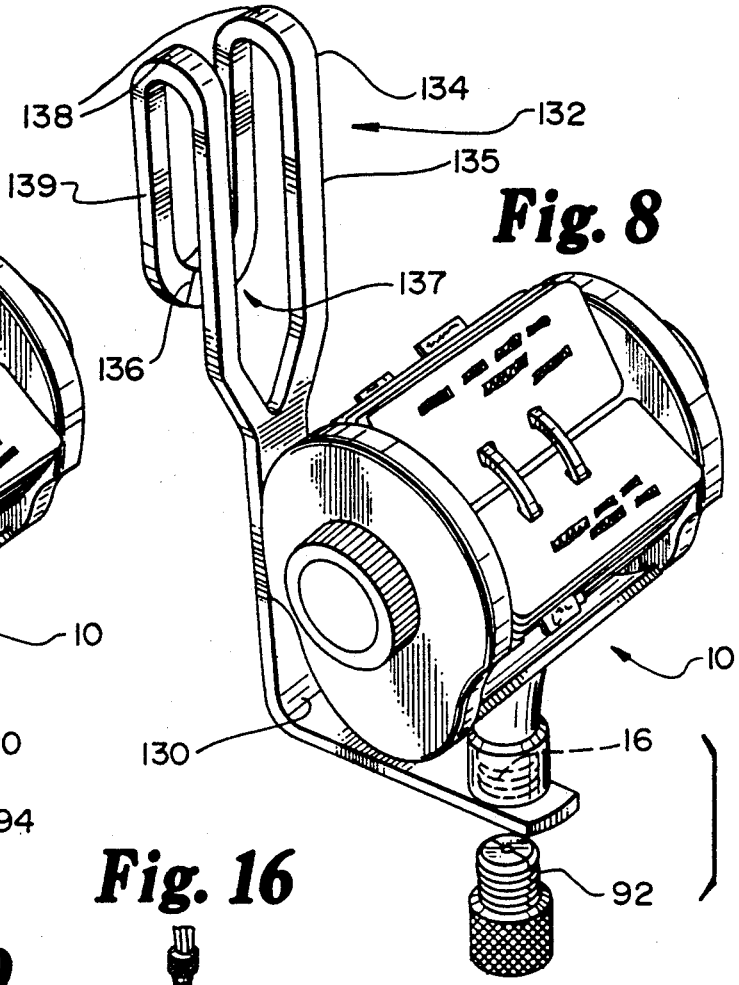
FIG. 8 is an exploded perspective view thereof showing an alternate form of bracket hanger.

FIGS. 8, 11 and 12 illustrate various fastening means for removably attaching the head member. FIG. 8 illustrates an "L" bracket member 130 designed to mount onto objects extending perpendicular to any given surface. The head may be attached to the bracket by a ferrule and nipple mechanism or by ball detent socket mount as described above.

The "L" bracket further contains a hook portion 132 which allows for mounting the head over an object which extends outward from a given surface. The hook further embodies a loop 134 with bends 138 forming a gap 135 and a stem space 139. The entire hook ends in a tongue 137. At approximately the center of the tongue, a slit 136 is present which allows for opening of the tongue to enable slipping the entire bracket over an object. The "L" bracket may be placed, for example, over a car mirror located on the interior of the windshield. The card file would then hang directly beneath the mirror for easy access for the user.

Figure 9:
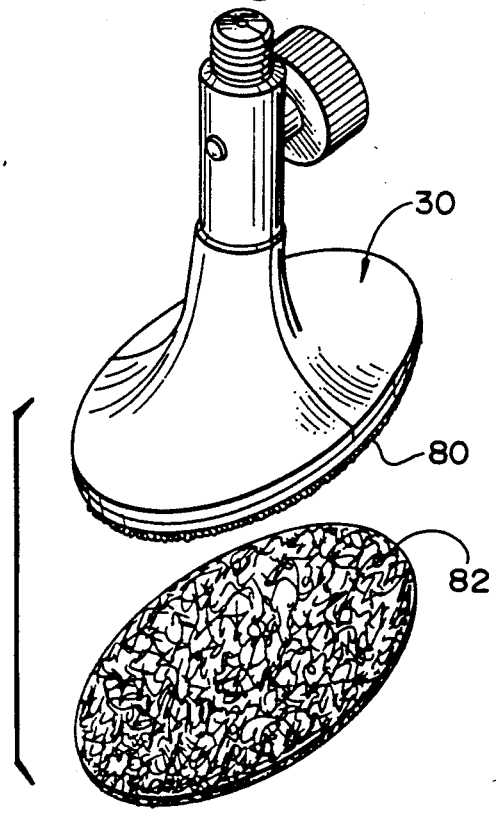
FIG. 9 is a perspective detail thereof showing an alternative Velcro® base mount.
Figure 10:
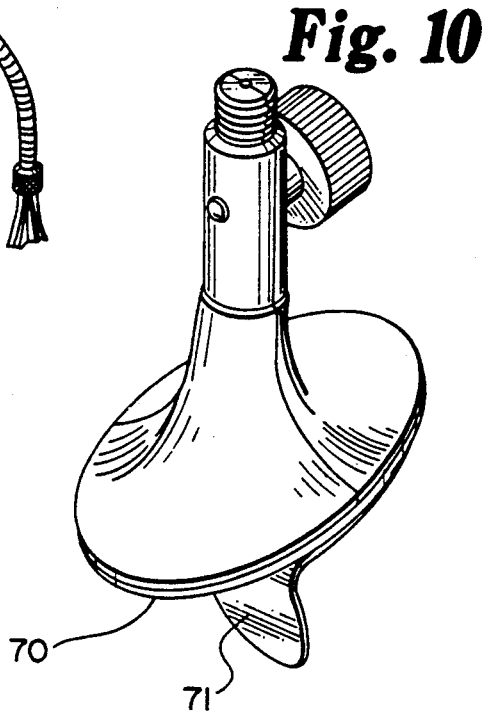
FIG. 10 is a perspective detail thereof showing an alternative adhesive base mount.

FIGS. 9 and 10 illustrate various mechanisms of adhering a base means to a surface. FIG. 9 illustrates a Velcro type hook 80 and eye 82 mechanism for adherence. FIG. 10 illustrates a contact adhesive mechanism 70 where a sponge rubber with adhesive faces is attached to the support base 32 and covered by a peel off layer 71.

A spherical socket 178 is adapted to receive the ball 176. The socket 178 is attached to the stem, base means or fastening means of the mobile card file.

Figure 15:
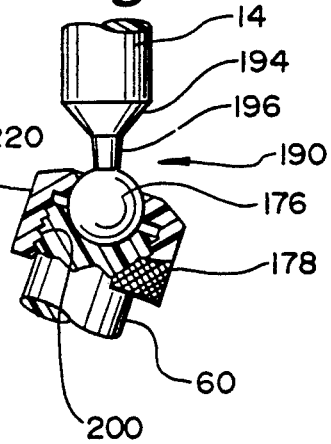
FIG. 15 is fragmentary detail with parts cut away thereof showing a detachable locking ball and socket mount.

The ball and socket mount may be modified slightly to allow for locking the head in place. FIG. 15 illustrates a locking ball and socket mount 190 which contains locking ring 220 with internally threaded region 200 . The ring 200 is placed over and cooperates with stem 60 which has an external threaded region (not shown). As a user rotates or tilts the head, the ball 176 is compressed into the socket 178 by means of the threaded interface. The threads or teeth then meet and form a "lock" to position the head in place.

A chamfer 194 located directly below the neck 14 tapers into a stand off 196 and aids in positioning the locking ring into the threaded regions available within the stem. A user can rotate the head and neck by gripping the chamfer and standoff and positioning the head into the desired location.

Figure 16:
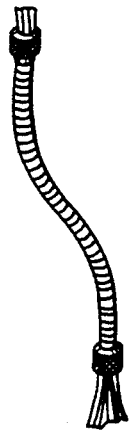
FIG. 16 is a fragmentary perspective detail thereof showing a flexible neck attachment.

FIG. 16 illustrates a flexible neck that allows for articulation of the head. This neck may be placed on the stem, base or fastening means. It allows the user greater placement of location of the head member 10.

OPERATION

In operation, the user attaches one of the desired base or fastening means to the vehicle dash, window or mirror mount. The head is loaded with addressed index cards. The head is then attached to the base and swiveled or tilted as needed to orient the cards for easy viewing.

When desired, the head may be removed from the base and attached to another base, such as on an office desk. The cards may then be updated as needed. This feature also allows the security of keeping confidential customer lists out of sight from car thieves.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A portable card file for use in cooperation with multiple bases or surfaces, said filed comprising:

a) a head for holding a plurality of index cards carrying information, said head including means for selectively viewing one card at a time, b) a first base means for supporting and accepting said head, said means constructed and arranged for facile detachment from said head without the need for tooling and further being constructed and arranged for securing said means to a surface, c) at least a second base means for supporting and accepting said head, said means constructed and arranged for facile detachment from said had without the need for tooling and further being constructed and arranged for securing said means to a surface, and;

the plurality of base means allowing for detachment of the head from each of the base means, making the head portable and readily transferable from one base member to another.

2. A card file according to claim 1 wherein each of the base means includes a support base and a stem, said stem extending outwardly from the support base, said stem being constructed and arranged to receive a head.

3. A card file according to claim 2 wherein the stem is constructed and arranged to allow rotation and tilting of the head relative to the stem and further includes a lock mechanism allowing the user to lock the head at a desired position.

4. A card file according to claim 3 wherein the stem includes a ball and socket mechanism constructed and arranged to allow the head to rotate, tilt and lock in place relative to the stem.

5. A card file according to claim 2 wherein the stem is constructed and arranged to allow rotation of the head relative to the stem.

6. A card file according to claim 2 wherein the stem is constructed and arranged to allow tilting of the head relative to the stem.

7. A card file according to claim 2 wherein the stem includes a bayonet mount constructed and arranged for releasing the head from the stem.

8. A card file according to claim 1 wherein each of the base means is constructed and arranged to allow rotation and tilting of the head relative to the base means and further includes a lock mechanism allowing the user to lock the head at a desired position.

9. A card file according to claim 8 wherein each of the base means includes a balland socket mechanism constructed and arranged to allow the head to rotate, tilt and lock in place relative to the base means.

10. A card file according to claim 1 wherein each of the base means is constructed and arranged to allow rotation of the head relative to the base means.

11. A card file according to claim 1 wherein each of the base means is constructed and arranged to allow tilting of the head relative to the base means.

12. A card file according to claim 1 wherein each of the base means includes a bayonet mount constructed and arranged for releasing the head from the base means.

13. A card file according to claim 1 wherein each of the base means includes contact adhesive for adhering said base means to a surface.

14. A card file according to claim 1 wherein each of the base means includes a suction mechanism constructed and arranged for adhering said base means to a surface.

15. A card file according to claim 1 wherein each of the base means includes a hook and eye mechanism constructed and arranged for adhering said base means to a surface.

16. A card file according to each of claim 1 wherein a flexible neck is attached to the base means to allow for greater placement of location of the head.

17. A card file according to claim 1 wherein each of the base means includes a spade mount.

18. A portable card file for use in cooperation with multiple fastening means or surfaces, said file comprising:

a) a head for holding a plurality of index cards carrying information, said head including means for selectively viewing one card at a time, b) a first fastening means for supporting and accepting said head, said means constructed and arranged for facile detachment from said head without the need for tooling and further being constructed and arranged for securing said means to a surface, c) at least a second fastening means for supporting and accepting said head, said means constructed and arranged for facile detachment from said head without the need for tooling and further being constructed and arranged for securing said means to a surface, and;

the plurality of fastening means allowing for detachment of the head from each of the fastening means, making the head portable and readily transferable from one base means to another.

19. A card file according to claim 18 wherein each of the fastening means includes a stem, said stem extending outwardly from the fastening means and being constructed and arranged to receive a head.

20. A card file according to the claim 19 wherein the stem is constructed and arranged to allow rotation and tilting of the head relative to the fastening means and includes a lock mechanism allowing the user to lock the head at a desired position.

21. A card file according to claim 19 wherein the stem is constructed and arranged to allow rotation of the head relative to the stem.

22. A card file according to claim 19 wherein the stem is constructed and arranged to allow tilting of the head relative to the stem.

23. A card file according to claim 19 wherein the stem includes a bayonet mount constructed and arranged for releasing the head from the stem.

24. A card file according to claim 8 wherein each of the fastening means is constructed and arranged to allow rotation and tilting of the head relative to the fastening means and includes a lock mechanism allowing the user to lock the head at a desired position.

25. A card file according to claim 18 wherein each of the fastening means is constructed and arranged to allow rotation of the head relative to the fastening means.

26. A card file according to claim 18 wherein each of the fastening means is constructed and arranged to allow tilting of the head relative to the fastening means.

27. A card file according to claim 18 wherein each of the fastening means includes a ball and socket mechanism constructed and arranged to allow the head to rotate, tilt and lock in place.

28. A card file according to claim 18 wherein each of the fastening means includes a bayonet mount constructed and arranged for releasing the head from the fastening means.

29. A card file according to claim 18 wherein each of the fastening means is a clamp.

30. A card file according to claim 18 wherein each of the fastening means is a spade mount.

31. A card file according to claim 18 wherein each of the fastening means is an "L" bracket constructed and arranged to allow mounting onto objects extending outwardly from a given surface.

32. A card file according to each of claim 18 wherein a flexible neck is attached to the fastening means to allow for greater placement of location of the head.

* * * * *

UNITED STATES PATENT AND TRADEMARK OFFICE

CERTIFICATE OF CORRECTION

PATENT NO. : 5,031,865

DATED : Jul. 16, 1991

INVENTOR(S) : Patrick D. Blattner

It is certified that error appears in the above-identified patent and that said Letters Patent is hereby corrected as shown below:

Columns 1-4 should be deleted and replaced with columns 1-4, as per attached pages.

Signed and Sealed this

Second Day of February, 1993

*Attest:*

STEPHEN G. KUNIN

*Attesting Officer*

*Acting Commissioner of Patents and Trademarks*

MOBILE CARD FILE

BACKGROUND OF THE INVENTION

1. Field of the Invention

This invention relates to a mobile card file which contains a head for holding index cards and a base or fastening means constructed and arranged so that the head is removably attached to the base or fastening means and may be inserted into another base or fastening means at a different location.

2. Description of the related art

Rotary card files are known in the art, such as Rolodex® brand rotary card files. However, these rotary card files in existence are not easily transferable from an office or stationary setting to a non-stationary setting such as a vehicle.

With the advent of the mobile car telephone, many people now work out of their automobiles. This necessitates carrying file books, address and telephone numbers and the like in order to more easily communicate with the public. A problem with current office information systems is that they are not easily mobile.

SUMMARY OF THE INVENTION

The invention consists of a head for holding a plurality of index cards and a base or fastening means which supports the head. The base or fastening means can be attached permanently or temporarily to a variety of surfaces. The head is removably attached to the base or fastening means. This removability allows for the head to be transferred from one base to another at a different location. The head or card file thus becomes "mobile" or "portable".

The head is constructed such that it has full range of rotation and tilt relative to the base and may be placed in any position desired by the user. A locking mechanism built into the device will allow the user to lock the head in the desired position.

BRIEF DESCRIPTION OF THE DRAWINGS

Figure 3:
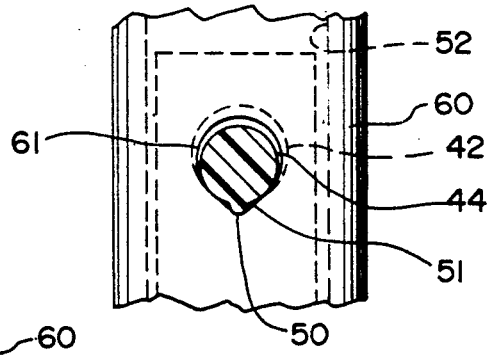
FIG. 3 is a fragmentary elevational detail thereof showing part of stem assembly.
Figure 4:
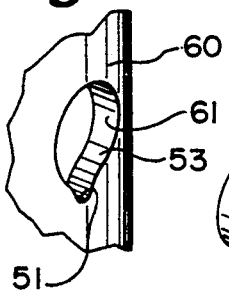
FIG. 4 is a fragmentary perspective detail thereof showing registration hole.
Figure 5:
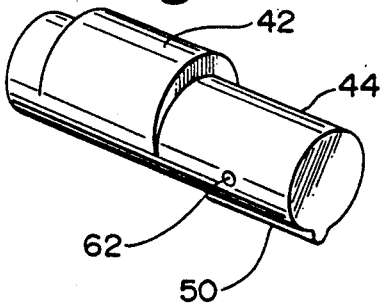
FIG. 5 is a perspective detail thereof showing actuator axle.

FIG. 1 is an exploded perspective view of the preferred form of the present invention;

FIG. 2 is a front elevational view thereof showing base with parts cut away;

FIG. 3 is a fragmentary elevational detail thereof showing part of stem assembly;

FIG. 4 is a fragmentary perspective detail thereof showing registration hole;

FIG. 5 is a perspective detail thereof showing actuator axle;

FIG. 6 is a fragmentary perspective detail thereof showing connecting rod end;

FIG. 7 is a fragmentary perspective thereof showing an alternate form of ferrule connection;

FIG. 8 is an exploded perspective view thereof showing an alternate form of bracket hanger;

FIG. 9 is a perspective detail thereof showing an alternative Velcro® base mount;

FIG. 10 is a perspective detail thereof showing an alternative adhesive base mount;

FIG. 11 is a perspective detail thereof showing a C-clamp base mount;

FIG. 12 is a perspective detail thereof showing a spade base mount;

FIG. 13 is a fragmentary side elevational exploded detail thereof showing a bayonet connection on mount;

FIG. 14 is a fragmentary detail with parts cut away thereof showing a detachable ball and socket connection on mount; and FIG. 15 is fragmentary detail with parts cut away thereof showing a detachable locking ball and socket mount.

FIG. 16 is a fragmentary perspective detail thereof showing a flexible neck attachment.

DESCRIPTION OF THE PREFERRED EMBODIMENTS

FIG. 1 illustrates a rotary card file containing a head member 10 removably attached to a base "means" 30 and which further contains a stem member 60. The head member 10 is constructed and arranged for holding a plurality of index cards 12 carrying information and includes means for selectively viewing one card at a time. Although a rotary head is shown, head member 10 may be a non-rotary index card head. Attached to the head is a neck member 14 with a terminal ferrule 16, said ferrule containing an internal thread (not shown). The base means 30 includes a support base structure 32 and a stem member 60 extending outwardly from the base means, said stem member having a terminally threaded nipple 92 for receiving the head member 10. The head is received onto the base means by threading the ferrule 16 with the nipple 92. A coupling cap may be used to achieve the same purpose as the ferrule without the necessity to turn the entire head when attaching the same onto the base means. Beneath the support base is located a suction cup 40 constructed and arranged for securing the base means to a surface. A surface such as a dash board of an automobile is envisioned. A parting line 31 is present in the base means where the base means is attached during assembly.

FIGS. 2–6 illustrate a standard suction mechanism.

An internal opening 52 is present within the stem of the base means to allow for placing of rod groove 56 and connecting rod 54.

The connecting rod 54 shown in FIGS. 2 and 6 contains a cam hole 64 to which the eccentric cam 42 of the actuator axle 44 abuts.

The suction is created by a user turning the actuator knob 48 relative to the base means, which surrounds the actuator axle 44. A knob retainer pin 46 threads into pin hole 62 within the actuator axle 44 and holds the knob 48 in place to allow for usage. A registration rib 50 slides into registration notch 51 upon turning of the knob 48. A clearance hole 61 which is formed in the stem 60 is large enough to permit the axle 44 with the registration rib 50 to turn and allow the notch and rib to meet. Upon engagement of axle 44 and the registration rib 50 into the notch 51, which fit into the registration hole 53, the rod groove 56 and lip 58 are lowered into the void space 102 and create the suction causing the base means to adhere to a given surface. Simultaneously upon engagement of rib 50 and notch 51, the eccentric cam 42 engages into a cam hole 64, shown in FIG. 6, which is formed in the connecting rod 54.

FIG. 7 illustrates an alternate embodiment to the threaded nipple mechanism shown in FIGS. 1 and 2 for the removal of the head from the base or fastening means. A ball detent socket mount 90 allows for vertical removal of the head 10 from a post 91. A ferrule 20 with internal grooves snaps over a ball detent 94.

FIGS. 8, 11, and 12 illustrate various fastening means for removably attaching the head member. FIG. 8 illustrates an "L" bracket member 130 designed to mount onto objects extending perpendicular to any given surface. The head may be attached to the bracket by a ferrule and nipple mechanism or by ball detent socket mount as described above.

The "L" bracket further contains a hook portion 132 which allows for mounting the head over an object which extends outward from a given surface. The hook further embodies a loop 134 with bends 138 forming a gap 135 and a stem space 139. The entire hook ends in a tongue 137. At approximately the center of the tongue, a slit 136 is present which allows for opening of the tongue to enable slipping the entire bracket over an object. The "L" bracket may be placed, for example, over a car mirror located on the interior of the windshield. The card file would then hang directly beneath the mirror for easy access for the user.

FIGS. 9 and 10 illustrate various mechanisms of adhering a base means to a surface. FIG. 9 illustrates a Velcro/type hook 80 and eye 82 mechanism for adherence. FIG. 10 illustrates a contact adhesive mechanism 70 where a sponge rubber with adhesive faces is attached to the support base 32 and covered by a peel off layer 71.

FIG. 11 illustrates a standard C-clamp 140 containing a clamp screw 146 which is turned via a "T"-bar 148. A puck 144 at the end of the clamp screw 146 secures the head 10 to the desired surface by butting up against the surface.

The head 10 may be fixedly attached to the clamp as shown in FIG. 11 via a common fastener 142.

FIG. 12 illustrates a standard spade socket mount 150. A bracket 158 is fixedly attached to a surface via the mounting holes 160 or adhesion or the like. A bridge detent 162 which contains spade socket 151 accepts a spade 154 to which is attached a head 10. A nerd detent 156 allows secure engagement of the spade onto the bracket.

FIG. 13 illustrates a standard bayonet mount 100 to allow for push button releasability of the head from the base or fastening means. This bayonet mount may be placed either on the base means, fastening means or the stem holding the head. A bayonent post 106 is attached to the neck member 14 of the head 10. A step 104 ends with a land 108 and a male lug 110. A bayonet socket 114 is adapted to receive the bayonet post 106. The socket 114 consists of an end 122 to which is attached an abutment lug 120 and a lug bay 118. At the base of the lug bay is located a female lug 116. The male lug 110 of the bayonet post is locked into the bayonet socket by a turning action in which the female and male lug meet.

FIG. 14 illustrates a standard ball and socket mount which allows for rotation and tilting of the head 10. This mount 170 consists of a spherical ball 176 attached to a stand off 174 which in turn is a attached to the neck member 14 of the head 10.

A spherical socket 178 is adapted to receive the ball 176. The socket 178 is attached to the stem, base means or fastening means of the mobile card file.

The ball and socket mount may be modified slightly to allow for locking the head in place. FIG. 15 illustrates a locking ball and socket mount 190 which contains locking ring 220 with internally threaded region 200. The ring 200 is placed over and cooperates with stem 60 which has an external threaded region (not shown). As a user rotates or tilts the head, the ball 176 is compressed into the socket 178 by means of the threaded interface. The threads or teeth then meet and form a "lock" to position the head in place.

A chamfer 194 located directly below the neck 14 tapers into a stand off 196 and aids in positioning the locking ring into the threaded regions available within the stem. A user can rotate the head and neck by gripping the chamfer and standoff and positioning the head into the desired location.

FIG. 16 illustrates a flexible neck that allows for articulation of the head. This neck may be placed on the stem, base or fastening means. It allows the user greater placement of location of the head member 10.

OPERATION

In operation, the user attaches one of the desired base or fastening means to the vehicle dash, window or mirror mount. The head is loaded with addressed index cards. The head is then attached to the base and swiveled or tilted as needed to orient the cards for easy viewing.

When desired, the head may be removed from the base and attached to another base, such as on an office desk. The cards may then be updated as needed. This feature also allows the security of keeping confidential customer lists out of sight from car thieves.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A portable card file for use in cooperation with multiple bases or surfaces, said file comprising:

a) a head for holding a plurality of index cards carrying information, said head including means for selectively viewing one card at a time, b) a first base means for supporting and accepting said head, said means constructed and arranged for facile detachment from said head without the need for tooling and further being constructed and arranged for securing said means to a surface, c) at least a second base means for supporting and accepting said head, said means constructed and arranged for facile detachment from said head without the need for tooling and further being constructed and arranged for securing said means to a surface, and;

the plurality of base means allowing for detachment of the head from each of the base means, making the head portable and readily transferable from one base member to another.

2. A card file according to claim 1 wherein each of the base means includes a support base and a stem, said stem extending outwardly from the support base, said stem being constructed and arranged to receive a head.

3. A card file according to claim 2 wherein the stem is constructed and arranged to allow rotation and tilting of the head relative to the stem and further includes a lock mechanism allowing the user to lock the head at a desired position.

4. A card file according to claim 3 wherein the stem includes a ball and socket mechanism constructed and